US010303098B2

(12) United States Patent
Soda et al.

(10) Patent No.: US 10,303,098 B2
(45) Date of Patent: May 28, 2019

(54) IMAGE FORMING APPARATUS

(71) Applicant: CANON KABUSHIKI KAISHA, Tokyo (JP)

(72) Inventors: Takamitsu Soda, Mishima (JP); Kazuhiro Funatani, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/112,403

(22) Filed: Aug. 24, 2018

(65) Prior Publication Data

US 2019/0064717 A1 Feb. 28, 2019

(30) Foreign Application Priority Data

Aug. 28, 2017 (JP) ..... 2017-163745

(51) Int. Cl.
*G03G 15/00* (2006.01)
*G03G 15/01* (2006.01)
*G03G 15/16* (2006.01)

(52) U.S. Cl.
CPC ..... *G03G 15/5008* (2013.01); *G03G 15/0136* (2013.01); *G03G 15/0189* (2013.01); *G03G 15/1615* (2013.01); *G03G 2215/0132* (2013.01); *G03G 2215/0193* (2013.01)

(58) Field of Classification Search
CPC ..... G03G 15/5008; G03G 15/0136; G03G 15/1615; G03G 15/0189; G03G 2215/0132; G03G 2215/0193
See application file for complete search history.

(56) References Cited

U.S. PATENT DOCUMENTS

2008/0219720 A1* 9/2008 Matsumoto ..... G03G 15/161 399/318
2014/0140741 A1* 5/2014 Nakura ..... G03G 15/0136 399/297

FOREIGN PATENT DOCUMENTS

JP 2005-266422 A 9/2005
JP 2010-217436 A 9/2010
JP 2013-019946 A 1/2013
JP 2016-191850 A 11/2016

* cited by examiner

*Primary Examiner* — Susan S Lee
(74) *Attorney, Agent, or Firm* — Canon U.S.A., Inc. IP Division

(57) ABSTRACT

A control unit first drives a photosensitive drum at a normal speed that is faster than a low speed, and the control unit subsequently changes the drive speed of the photosensitive drum from the normal speed to the low speed after a transfer belt is brought into contact with the photosensitive drum that is driven at the normal speed.

13 Claims, 9 Drawing Sheets

IMAGE FORMING APPARATUS

BACKGROUND OF THE INVENTION

Field of the Invention

The present invention relates to an image forming apparatus, such as a copier or a printer, that has a function to form an image on a recording medium, such as a sheet.

Description of the Related Art

An image forming apparatus, such as a copier or a printer, that employs an electrophotographic technique is known. By using the electrophotographic technique, an image is formed on a recording medium in such a manner that a toner image that has been formed on a photosensitive drum (photosensitive member) is transferred onto a recording medium, such as a sheet of paper, by using electrostatic forces, and the toner image is subsequently fused and fixed onto the recording medium by a fixing device.

In the image forming apparatus, a cleaning blade is used to clean toner. The cleaning blade that is in contact with the photosensitive drum serves as a cleaning unit to scrape and clean residual toner on the photosensitive drum. The cleaning blade is formed such that the material and the preset angle and inroad amount relative to the photosensitive drum are optimized so as to exhibit the maximum cleaning performance at a driving speed of the photosensitive drum, which is designed to be a standard speed for printing.

When the photosensitive drum is driven, the cleaning blade may generate vibrations by switching between a state in which the edge of the elastic blade is turned up a little and a state in which the elastic blade returns to the original position. Vulnerability of vibration depends upon the above settings of the cleaning blade, and the frequency of vibration at the edge becomes large when the frequency is in tune with the natural frequency of the cleaning blade. The cleaning blade also tends to vibrate when the photosensitive drum rotates in an unstable condition in the image forming apparatus. In such a case, the frictional resistance between the cleaning blade and the photosensitive drum increases.

When the cleaning blade vibrates for such reasons, an unusual sound may be generated between the cleaning blade and the photosensitive drum, and faulty cleaning may occur.

Japanese Patent Laid-Open No. 2016-191850 proposes a configuration for suppressing generation of an unusual sound by bringing a photosensitive drum and an intermediate transfer belt into contact with each other before the photosensitive drum starts to be driven while an image forming speed (processing speed) at which the cleaning blade tends to vibrate is used in image forming.

However, in the case in which the photosensitive drum and the intermediate transfer belt are brought into contact with each other before the photosensitive drum starts to be driven, the photosensitive drum and the intermediate transfer belt slide against each other when the photosensitive drum starts to be driven, which leads to the likelihood of the photosensitive drum being worn.

SUMMARY OF THE INVENTION

Embodiments of the invention provide an image forming apparatus that reduces wear of a photosensitive drum and that suppresses vibrations occurring between a cleaning blade and a photosensitive drum when the photosensitive drum starts to be driven.

The image forming apparatus includes a photosensitive drum that bears a toner image, a cleaning unit that is in contact with the photosensitive drum and cleans toner from the photosensitive drum, a transfer belt that transfers the toner image from the photosensitive drum to a recording medium, and a control unit that controls drive speed of the photosensitive drum. In the image forming apparatus, the control unit drives the photosensitive drum at a first drive speed that is the slowest among drive speeds that can be set by the control unit in a case that the photosensitive drum and the transfer belt are separated from each other and the photosensitive drum stops, and the control unit subsequently changes the drive speed of the photosensitive drum from a second drive speed to the first drive speed after the transfer belt is brought into contact with the photosensitive drum that is driven at the second drive speed, the second drive speed being faster than the first drive speed.

Further features of the present invention will become apparent from the following description of exemplary embodiments with reference to the attached drawings.

DESCRIPTION OF THE EMBODIMENTS

Exemplary embodiments of the invention will be described with reference to the drawings. Note that dimensions, materials, shapes, relative positions, or the like, of elements described in the embodiments below may be changed appropriately in accordance with configurations and various conditions of an apparatus to which the present invention is applied, and accordingly, the embodiments described below should not be construed as limiting the scope of the invention.

First Embodiment

Figure 1:
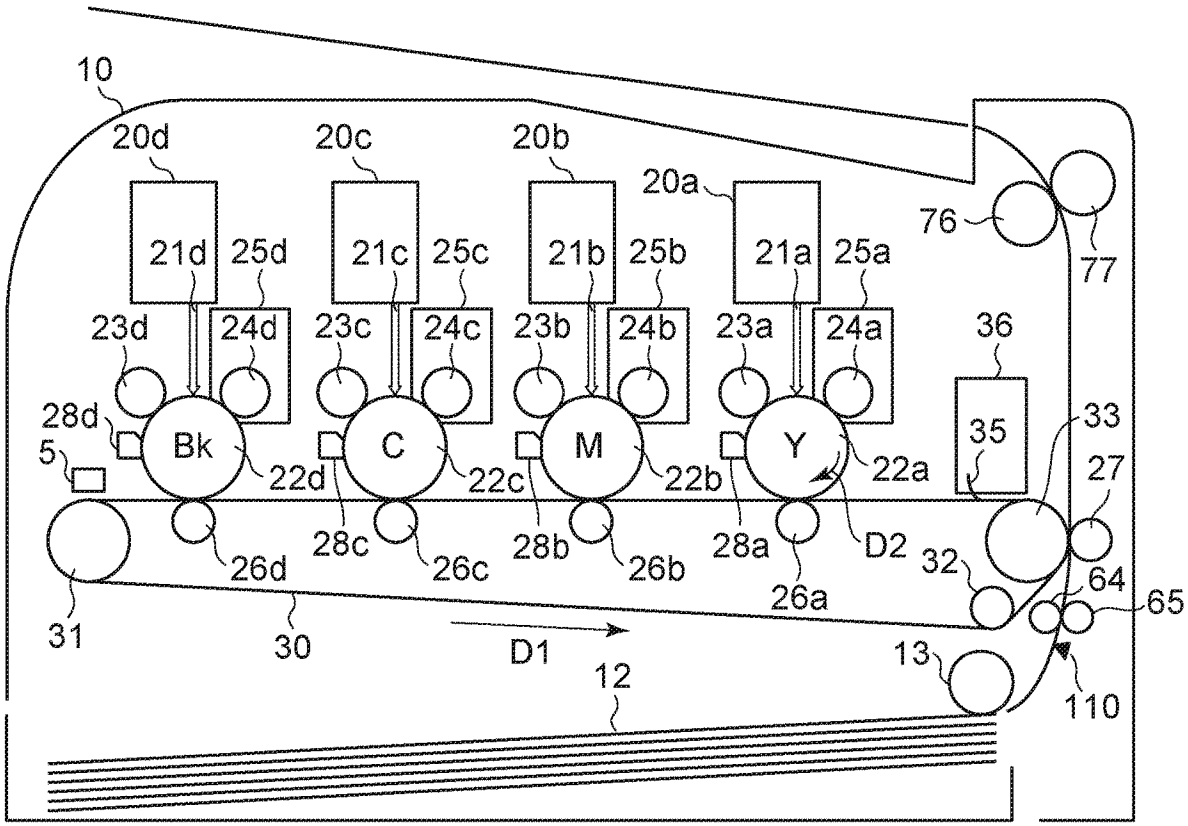
FIG. 1 is a diagram illustrating a color image forming device to which the invention is applied.

FIG. 1 is a diagram illustrating a color image forming apparatus 10 that employs a tandem system (four-drum type) and an intermediate image transfer system. In an image forming process, a pickup roller 13 feeds a recording medium 12 and stops feeding temporarily when the leading edge of the recording medium 12 passes a conveyance roller pair 64 and 65 after the position of the leading edge of the recording medium 12 is detected by a registration sensor 110. To look at color stations, scanner units 20*a* to 20*d* are disposed and include reflecting mirrors and a laser diode (light-emitting element). The color stations, which correspond to yellow (Y), magenta (M), cyan (C), and black (Bk) (hereinafter referred to as 1st to 4th color stations, respectively), include respective photosensitive drums. Photosensitive drums 22*a* to 22*d*, which are disposed in the respective color stations, are rotationally driven in the movement directions D2 at a certain peripheral speed (hereinafter referred to as a "processing speed"). The scanner units 20*a* to 20*d* emit laser light 21*a* to 21*d* consecutively to the respective photosensitive drums 22*a* to 22*d*.

Note that suffix a, b, c, or d attached to each reference numeral denotes that the referenced component serves for yellow, magenta, cyan, or black, respectively, and this notation applies throughout the description. The photosensitive drums 22*a* to 22*d* are charged in advance by respective charging rollers 23*a* to 23*d*. For example, a voltage of −1200 V is applied to each charging roller, and the surface of each photosensitive drum is charged to a voltage of −700 V. Electrostatic latent images are formed by irradiating the charged surfaces of the photosensitive drums with respective laser light 21*a* to 21*d*. For example, the potential of the portion exposed to laser light becomes −100 V. For example, a voltage of −350 V is applied to development rollers 24*a* to 24*d* included in respective development units 25*a* to 25*d*. Toner that is charged to negative polarity is supplied onto the electrostatic latent image on each of the photosensitive drums 22*a* to 22*d*, and the electrostatic latent image is thereby developed into a toner image on each photosensitive drum.

Primary transfer rollers 26*a* to 26*d* are first transfer members, and, for example, a primary transfer voltage of +1000 V, which has positive polarity, is applied to the primary transfer rollers 26*a* to 26*d*. Respective toner images on the photosensitive drums 22*a* to 22*d* are transferred by the primary transfer rollers 26*a* to 26*d* to an intermediate transfer belt 30 (hereinafter referred to as an "ITB"), which serves as a transfer belt. The transfer belt is a belt that serves to transfer the toner image from each photosensitive drum 22 to a recording medium. Residual toner that has not been transferred onto the ITB 30 and remained on the photosensitive drums 22*a* to 22*d* is cleaned by respective cleaning blades 28*a* to 28*d*, which are disposed to serve as cleaning units. Cleaning blades 28 are elastic blades made of urethane rubber or the like.

Figure 2:
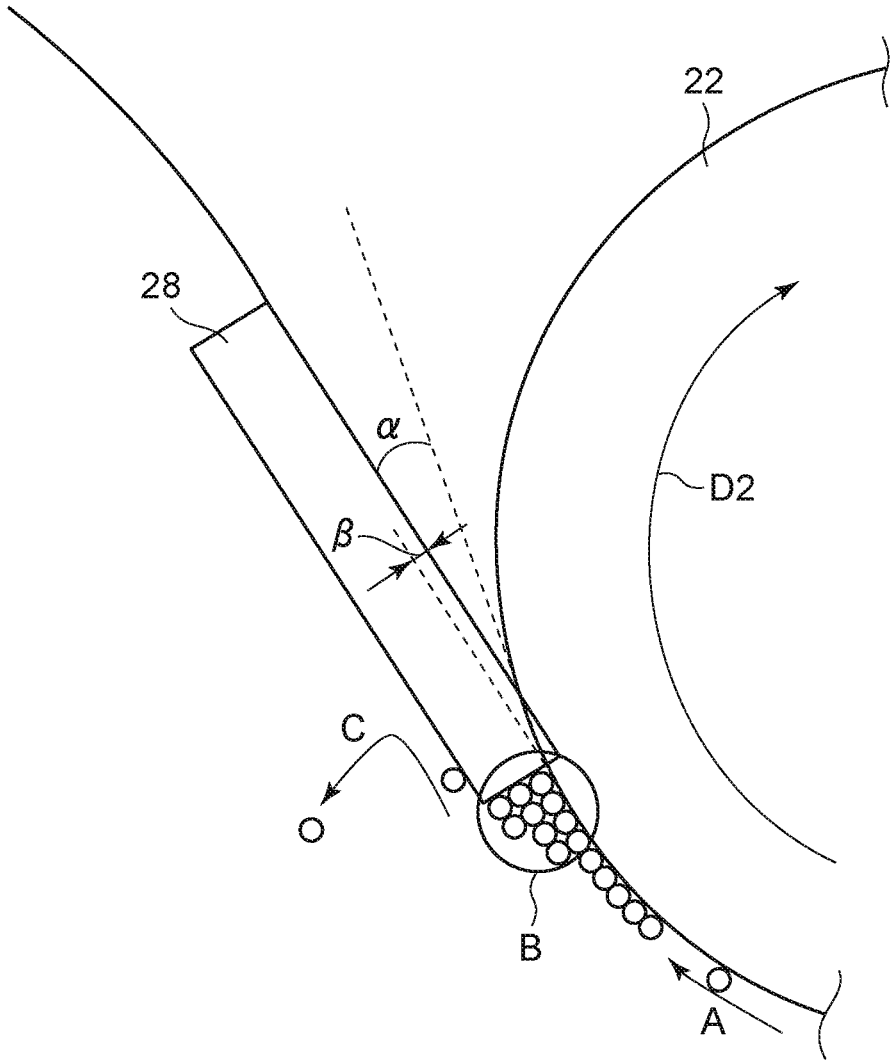
FIG. 2 is an enlarged view of a photosensitive drum and a cleaning blade, illustrating a state in which the cleaning blade scrapes toner.

FIG. 2 is an enlarged view of a cleaning blade 28 and a photosensitive drum 22, illustrating a state in which the cleaning blade scrapes toner. The cleaning blade 28 is attached so as to satisfy a preset angle a and a predetermined inroad amount β with respect to the photosensitive drum 22. The preset angle α is an angle between the cleaning blade 28 and the tangent to the photosensitive drum 22 at the point at which the cleaning blade 28 is in contact with the photosensitive drum 22. Toner on the photosensitive drum is moved from an upstream region A to a blade end B with respect to the rotation direction of the photosensitive drum by the rotation of the photosensitive drum in the direction D2. The toner is scraped by the blade end B and accumulates at the blade end B. The toner accumulating at the blade end B falls into, and is collected by, a residual toner container in a downstream region with respect to the toner conveyance direction. A portion of the toner accumulating at the blade end B slips under a cleaning edge of the cleaning blade 28 and is rubbed between the cleaning blade 28 and the photosensitive drum 22, thereby imparting lubricity to the surface of the photosensitive drum 22.

The ITB 30 extends around a drive roller 31 and extension rollers 32 and 33 and is rotationally driven by the drive roller 31 in the movement direction D1 at the same processing speed as that of the photosensitive drums 22*a* to 22*d*. The toner image is thereby conveyed to a secondary transfer roller 27, which serves as a second transfer member. At this time, the feed of the recording medium 12 is resumed such that the conveyed toner image meets the recording medium 12 at a secondary transfer position at which a secondary transfer roller 27 and the ITB 30 nip the recording medium 12. A secondary transfer bias is applied to the secondary transfer roller 27, and the toner image is thereby transferred from the ITB 30 to the recording medium 12.

The toner image on the recording medium 12 is subsequently heated and fixed by a fixing roller pair 76 and 77, and the recording medium 12 is discharged out of the apparatus. Toner that has not been transferred from the intermediate transfer belt 30 to the recording medium 12 by the secondary transfer roller 27 is collected into a residual toner container 36 by a cleaning blade 35 that serves for the intermediate transfer belt.

Note that a first contact/separation device 50 for each color is disposed so as to be able to switch between a contact state and a separation state of each of the development rollers 24*a* to 24*d* and the corresponding one of the photosensitive drums 22*a* to 22*d*. The above development process is performed while the development rollers 24*a* to 24*d* and the photosensitive drums 22*a* to 22*d* are brought into contact with each other by the respective first contact/separation device 50. In addition, a second contact/separation device is disposed so as to be able to switch between a contact state and a separation state of the ITB 30 and the photosensitive drums 22*a* to 22*d*. The above primary transfer process is performed while the ITB 30 and the photosensitive drums 22*a* to 22*d* are in the contact state.

Figure 8A:
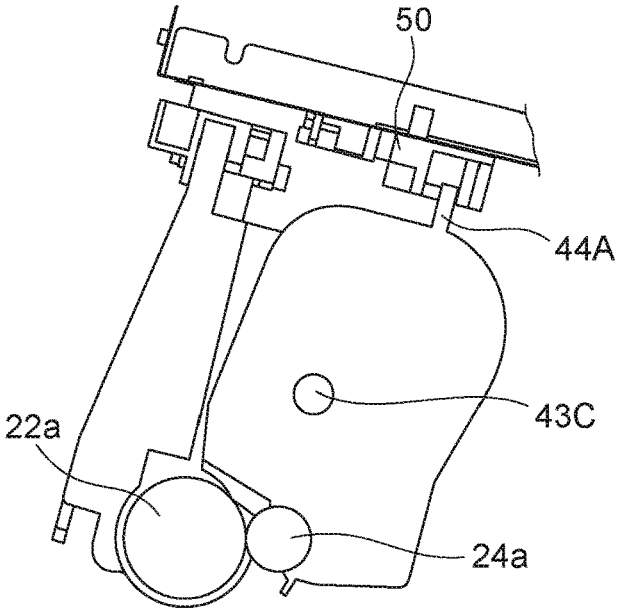
FIG. 8A is a schematic view illustrating a contact state caused by a first contact/separation device.
Figure 8B:
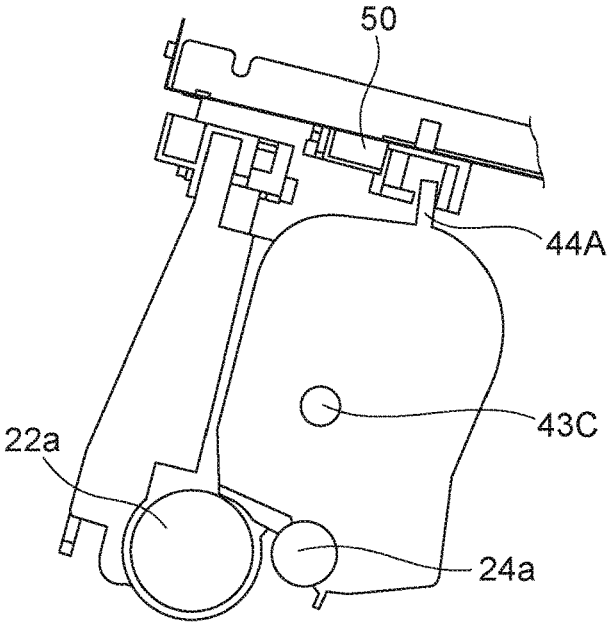
FIG. 8B is a schematic view illustrating a separation state caused by the first contact/separation device.

The first contact/separation device 50 will be described below with reference to FIGS. 8A and 8B. Note that although the contact state (FIG. 8A) and the separation state (FIG. 8B) of a development roller 24*a* and a photosensitive drum 22*a* will be described, the same applies to the respective relations between development rollers 24*b* to 24*d* and photosensitive drums 22*b* to 22*d*.

A slide member 50, which serves as the first contact/separation device 50, is a member that is slidably moved by a control unit 101 and that engages a protrusion 44A included in a development unit 25*a*. When the slide member 50 causes the protrusion 44A to slide, the development unit 25*a* rotates about a rotation center 43*c*. The development roller 24*a* is thereby brought into contact with, or separated from, the photosensitive drum 22*a*.

The second contact/separation device will be described below.

An ITB 30, the primary transfer rollers 26*a* to 26*d*, and other members constitute an ITB unit 30*u*.

Operation of a mechanism that causes the primary transfer rollers 26*a* to 26*d* of the ITB unit 30*u* to be in contact with, or separated from, the respective photosensitive drums 22*a* to 22*d* will be described with reference to FIG. 9A.

Four primary transfer rollers 26*a* to 26*d* are attached to the ITB unit 30*u* so as to oppose the respective photosensitive drums 22*a* to 22*d*. The ITB unit 30*u* includes a separation mechanism that can cause the primary transfer rollers 26*a* to 26*d* to be in contact with, or separated from, the respective photosensitive drums 22*a* to 22*d*. Two contact/separation modes are available for the contact/separation operation performed in response to a print signal.

The first contact/separation mode is an all-separation state in which all the primary transfer rollers 26*a* to 26*d* are separated from the respective photosensitive drums 22*a* to 22*d*. This is a mode for separating the ITB 30 from the photosensitive drums 22*a* to 22*d* during pre-rotation or post-rotation in printing to eliminate sliding or reduce sliding resistance. This is a mode for preventing sliding portions from being subjected to wear.

The second contact/separation mode is an all-contact state in which all the primary transfer rollers 26*a* to 26*d* are brought into contact with the respective photosensitive drums 22*a* to 22*d*. This is a mode for enabling toner images on all the photosensitive drums 22*a* to 22*d* to be primary-transferred to the ITB 30 during printing.

Next, a mechanism of switching between the contact mode and the separation mode will be described with reference to FIG. 9B.

Figure 9A:
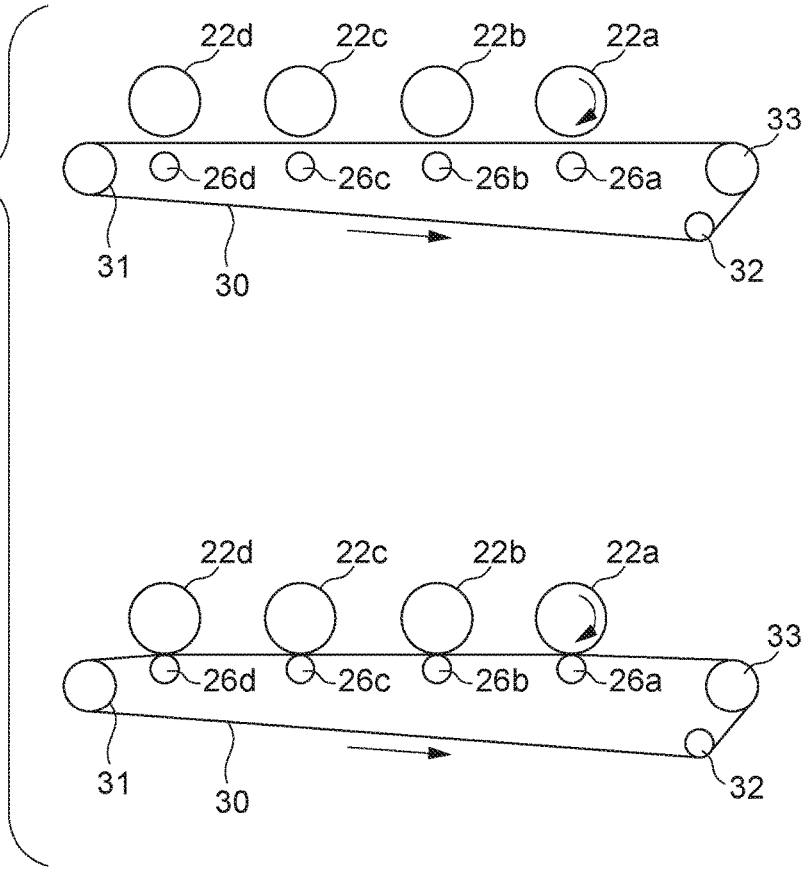
FIG. 9A is a schematic view illustrating a contact state and a separation state that are caused by a second contact/separation device.
Figure 9B:
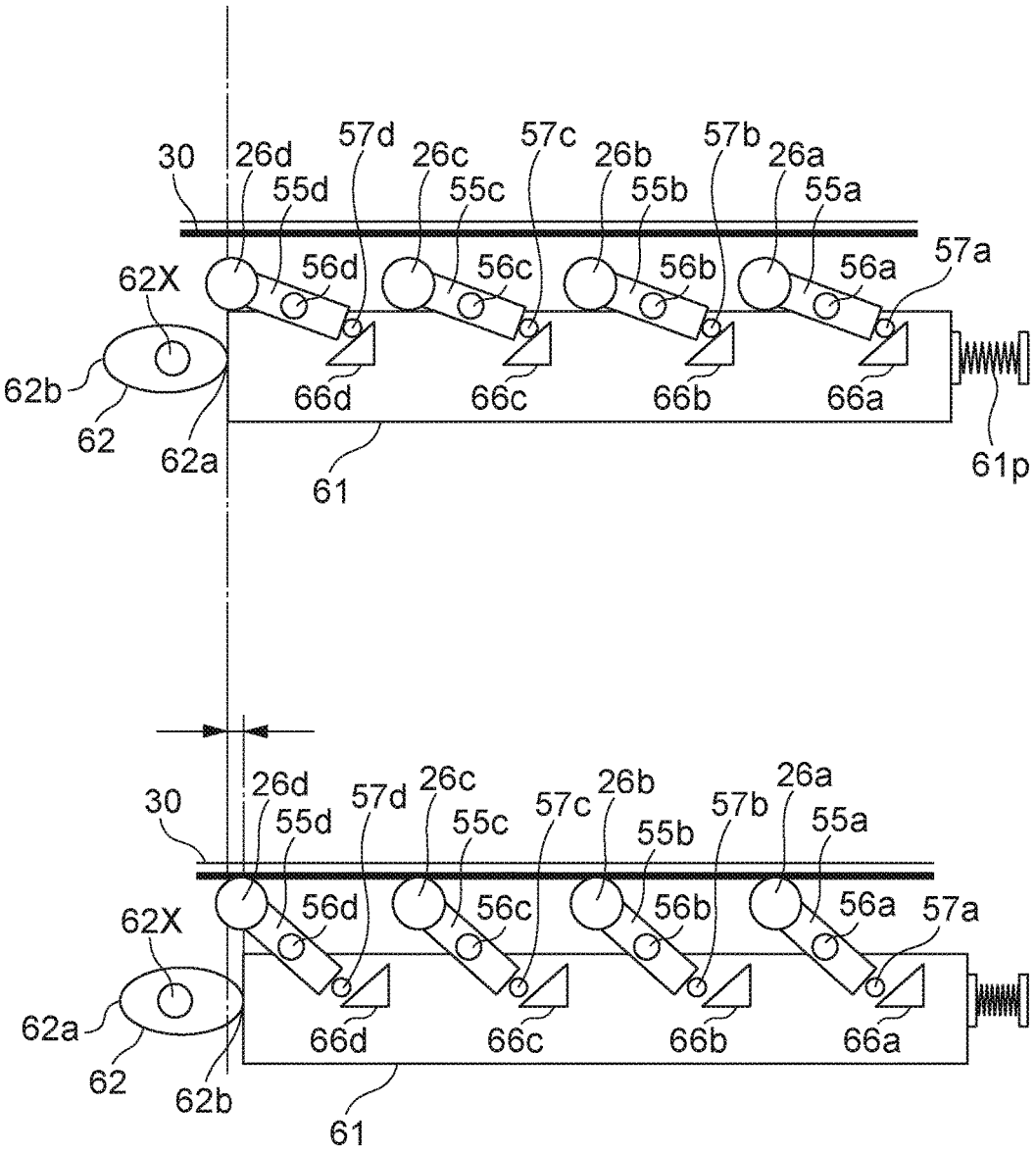
FIG. 9B is a schematic view illustrating the contact state and the separation state that are caused by the second contact/separation device.

A mechanism illustrated in FIG. 9B is formed in the ITB unit 30*u* so as to cause the four primary transfer rollers 26*a* to 26*d* to turnably move in the up-down direction in FIG. 9B in a reciprocating manner. The primary transfer rollers 26*a* to 26*d* are attached to respective primary transfer roller support members 55*a* to 55*d* that can rotate about corresponding rotation centers 56*a* to 56*d*. A spring (not illustrated) imparts a clockwise moment of rotation to each of the primary transfer roller support members 55*a* to 55*d*, which are thereby urged toward the ITB 30. In addition, the primary transfer roller support members 55*a* to 55*d* have respective control shaft portions 57*a* to 57*d* that are disposed at the respective ends opposite to the primary transfer rollers 26*a* to 26*d* with the rotation centers 56*a* to 56*d* therebetween.

The ITB unit 30*u* includes a contact/separation cam 62 that is disposed therein so as to be able to rotate about a cam shaft 62X. The contact/separation cam 62 has two working surfaces 62*a* and 62*b*. A drive control section (not illustrated) is provided on the shaft of the contact/separation cam 62 so as to enable the contact/separation cam 62 to rotate by 180 degrees at a time.

Reference numeral 61 denotes a control slider member that is disposed so as to be slidable in the horizontal direction in FIG. 9B. The control slider member 61 is urged toward the cam 62 by a compression spring 61*p*. Accordingly, as illustrated in FIG. 9B, the control slider member 61 has two stop positions corresponding to the two working surfaces of the cam 62.

Slope portions 66*a* to 66*d* are disposed in the control slider member 61 so as to correspond to the control shaft portions 57*a* to 57*d* included by the respective support members 55*a* to 55*d* of the four primary transfer rollers 26*a* to 26*d*. The clockwise moments of rotation about the rotation centers 56*a* to 56*d* are imparted to the respective control shaft portions 57*a* to 57*d* of the primary transfer roller support members 55*a* to 55*d*. Accordingly, the slope portions 66*a* to 66*d* are formed so as to enable the respective primary transfer rollers 26*a* to 26*d* to move reciprocally to and from the ITB 30 depending on the horizontal position of the control slider member 61 in FIG. 9B.

The slope portions 66*a* to 66*d* are adapted so as to move the four primary transfer rollers 26*a* to 26*d* in such a manner that two positions at which the control slider member 61 is stopped correspond to the contact mode and the separation mode, respectively, as illustrated in FIG. 9A. Thus, as illustrated in FIG. 9B, the slope portions 66*a* to 66*d* are disposed such that the all-separation state and the all-contact state can be switched by rotating the contact/separation cam 62 by 180 degrees at a time.

In the all-contact mode, as opposed to the all-separation mode, all the primary transfer rollers 26*a* to 26*d* are allowed to rotate about the respective rotation centers 56*a* to 56*d* to the extent of the shift amount of the slope portion 66*d* and are allowed to move upward in FIG. 9B toward the photosensitive drums 22*a* to 22*d*. Consequently, the primary transfer rollers 26*a* to 26*d* come into contact with the ITB 30.

Figure 3:
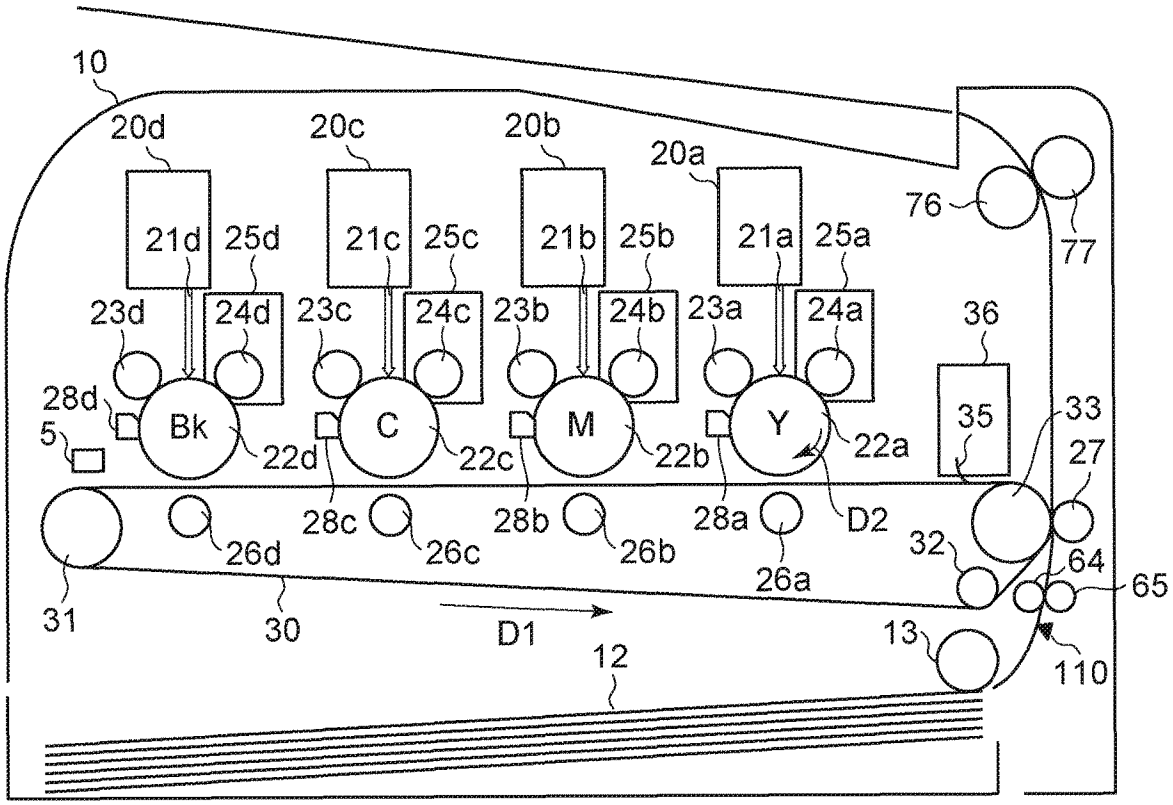
FIG. 3 is a diagram illustrating the color image forming apparatus to which the invention is applied.

FIG. 3 is a cross-sectional view illustrating a state in which the first contact/separation device causes the development rollers 24*a* to 24*d* and the corresponding photosensitive drums 22*a* to 22*d* to be separated from each other and the second contact/separation device causes the ITB 30 and the photosensitive drums 22*a* to 22*d* to be separated from each other. In the case in which the ITB 30 and the photosensitive drums 22*a* to 22*d* are in the separation state as illustrated in FIG. 3, the primary transfer rollers 26*a* to 26*d* may be separated from the ITB 30 or may remain in contact with the ITB 30.

Figure 4:
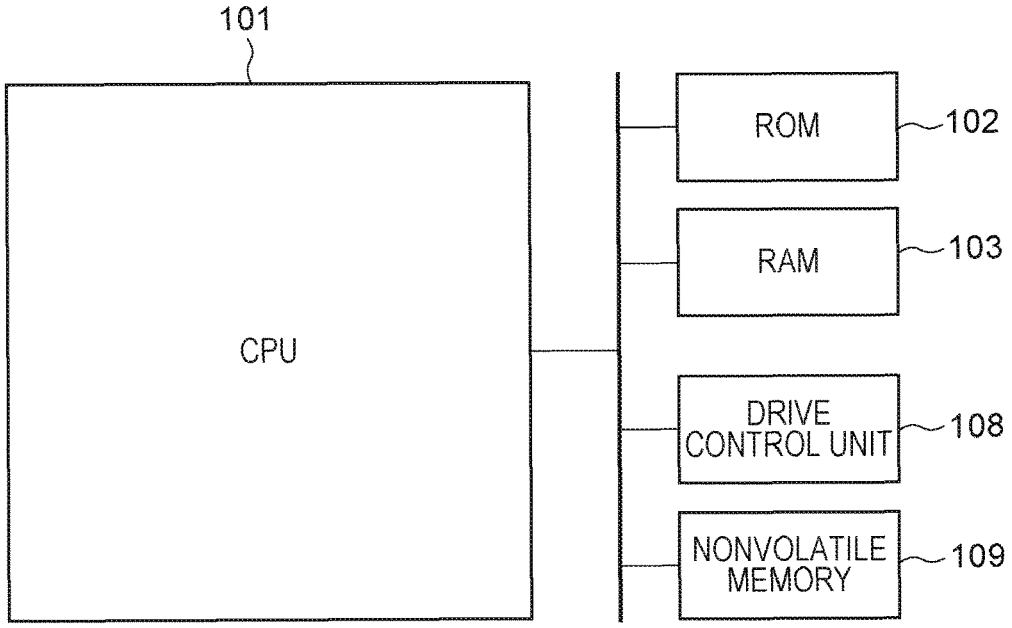
FIG. 4 is a block diagram of an exemplary control unit according to a first embodiment.

FIG. 4 is a block diagram of an exemplary control unit. A CPU 101, which serves as the control unit, controls individual sections of the image forming apparatus in accordance with various control programs stored in ROM 102 while using RAM 103 as a work area. The ROM 102 stores various control programs, data, tables, or the like. The RAM 103 provides a program loading area, a work area for the CPU 101, a data storage area, and areas for other purposes. A nonvolatile memory 109 is a storage device that stores various data. In accordance with instructions from the CPU 101, a drive control unit 108 controls multiple motors for driving the photosensitive drums 22*a* to 22*d*, the charging rollers 23*a* to 23*d*, the scanner unit 20*a* to 20*d*, the development rollers 24*a* to 24*d*, and the ITB 30. The CPU 101 also controls the first contact/separation device, the second contact/separation device, the charging voltage, the development voltage, and others.

Next, sliding in relation to the ITB will be described below. The sliding occurs in a process in which each photosensitive drum 22 and the ITB 30 are in contact with each other while both are stopped, and subsequently the photosensitive drum 22 and the ITB 30 start to be driven.

Figure 5:
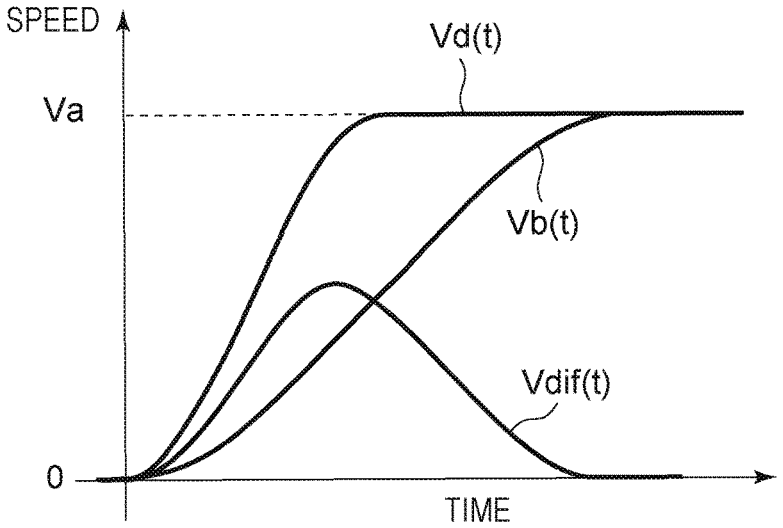
FIG. 5 is a graph related to an acceleration process starting from a state in which each of the photosensitive drums and an intermediate transfer belt are stopped and ending at a state in which each of the photosensitive drums and the intermediate transfer belt are driven at the same speed.

FIG. 5 is a graph related to an acceleration process starting from a state in which each photosensitive drum 22 and the ITB 30 are stopped and in contact with each other and ending at a state in which the photosensitive drum 22 and the ITB 30 are driven at the same speed Va. More specifically, FIG. 5 is a graph showing time dependences Vd (t) and Vb (t) of the respective peripheral speeds of the photosensitive drum 22 and the ITB 30 and a time dependence Vdif (t) of the drive speed difference between Vd (t) and Vb (t).

The velocity profiles of the photosensitive drum 22 and the ITB 30 in an acceleration phase may become different depending on the characteristics of motors when different motors are used as drive sources. Even when a common motor is used as the drive source, the difference in peripheral speed still occurs due to, for example, the difference in time loss until gears operably engage each other. Such a state is indicated by Vdif (t). The peripheral speed is increased while the primary transfer section is in contact with the photosensitive drum. Accordingly, when there is a difference in peripheral speed, the drum and the belt may slide against each other and may be worn.

Such sliding may also occur during speed change from the state in which the photosensitive drum 22 and the ITB 30 are in contact with each other and driven at a predetermined speed. However, the sliding occurring in the acceleration process from the stop state is noticeably large. The reason is that the difference in time loss until gears operably engage each other occurs normally in the acceleration process from a stop state. For example, in a period in which gears for one device operably engage each other while gears for another device do not operably engage yet, the one device that is already driven slides against the other device. In this case, damage is concentrated on one point on the surface of the other device and becomes larger. On the other hand, in the case of speed change while devices are driven, the damage concentration does not occur easily.

Similar sliding occurs during a deceleration process in which the photosensitive drum 22 and the ITB 30 are decelerated, and consequently stopped, from the state in which the photosensitive drum 22 and the ITB 30 are in contact with each other and driven at a predetermined speed. The stop timing of the photosensitive drum 22 and the stop timing of the ITB 30 are not synchronized with each other normally, thereby leading to sliding similar to that in the acceleration process.

Figure 6:
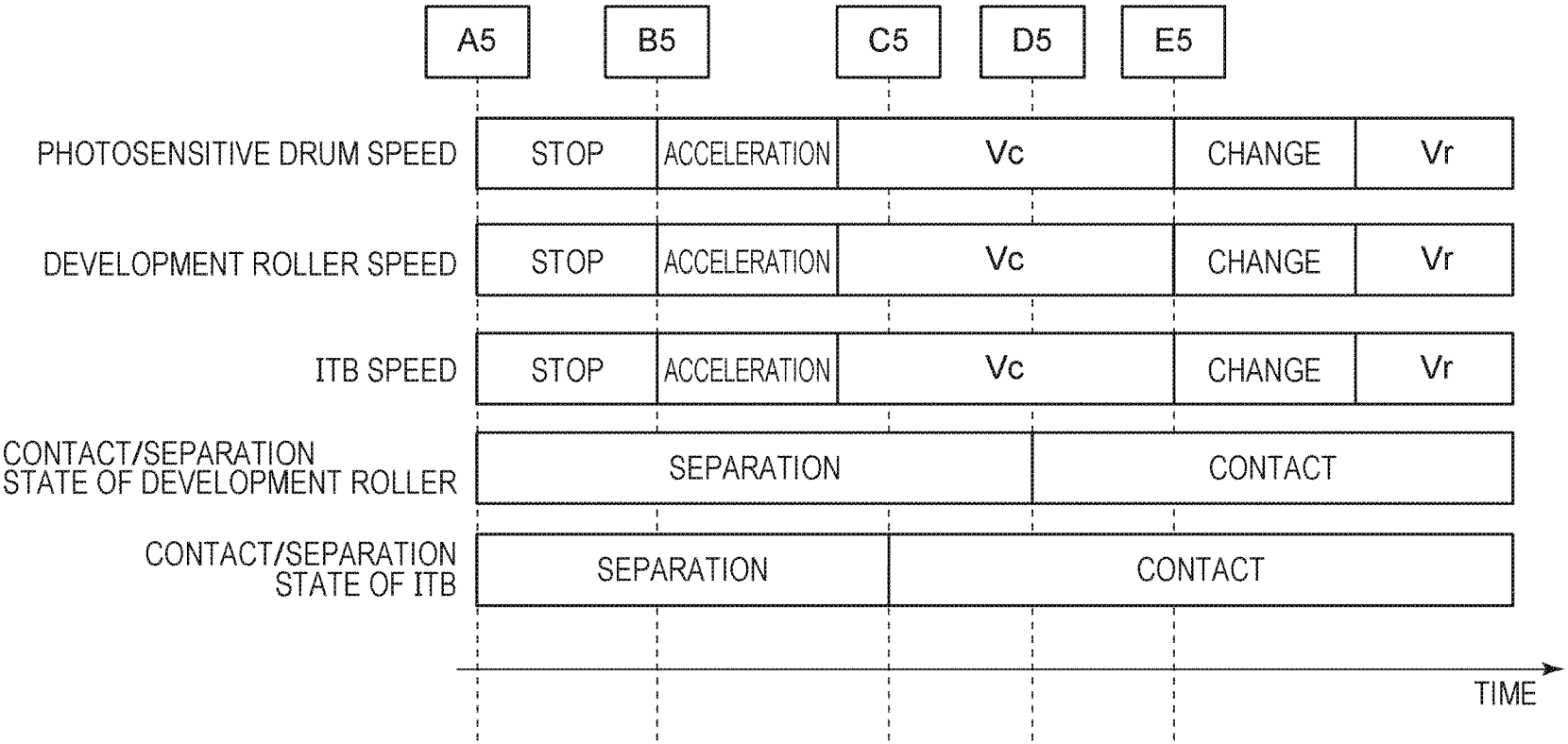
FIG. 6 is a view illustrating discrete states in relation to time in the acceleration process according to the first embodiment.

A way to reduce wear of the photosensitive drums 22*a* to 22*d* caused by the sliding against the ITB 30 and to suppress generation of an unusual sound by the cleaning blade will be described in accordance with the present embodiment. FIG. 6 illustrates a relationship of the drive speed of the photosensitive drums 22*a* to 22*d*, the drive speed of the ITB 30, the contact/separation state of the ITB 30 and the photosensitive drums 22*a* to 22*d*, the contact/separation state of the development rollers 24*a* to 24*d* and the photosensitive drums 22*a* to 22*d*, and time.

Reference Vr denotes a first drive speed, and reference Vc denotes a second drive speed that is a normal processing speed, which will be described later. Vr is a drive speed that is set slower than Vc and that is the slowest speed among the drive speeds that can be set by the drive control unit 108. In general, the image forming apparatus 10 performs image forming at multiple speeds (processing speeds) that can be set for use. Note that various settings in the image forming apparatus 10 are optimized for use at the second drive speed Vc, which is a processing speed to be used in the normal setting. The first drive speed Vr is a drive speed that is used, for example, when the temperature of the fixing roller pair 76 and 77 is set lower to prevent the temperature of the fixing roller pair 76 and 77 from rising excessively.

Reference A5 denotes an initial state, and references B5, C5, D5, and E5 denote timing of discrete state changes.

Reference A5 denotes the timing at which the ITB 30 is separated from the photosensitive drums 22*a* to 22*d*, the development rollers 24*a* to 24*d* are separated from the respective photosensitive drums 22*a* to 22*d*, and the photosensitive drums 22*a* to 22*d*, the ITB 30, and the development rollers 24*a* to 24*d* are in the stop state. In other words, each photosensitive drum 22 and the intermediate transfer belt 30 are separated from each other, while the photosensitive drum 22 is stopped.

In the state at the timing A5, as illustrated in FIG. 6, the ITB 30 is separated from the photosensitive drum 22. In this state, each photosensitive drum 22 and the ITB 30 are accelerated as indicated by the timing B5. The sliding between each photosensitive drum 22 and the ITB 30 can be thereby reduced. However, in the case of the drive speed of each photosensitive drum 22 being the first drive speed Vr, vibrations may occur between the photosensitive drum 22 and the corresponding cleaning blade 28, which generates an unusual sound.

According to the present embodiment, in the case in which the drive speed of the photosensitive drum 22 is increased from the stop state to the first drive speed Vr, the drive speed of the photosensitive drum 22 is first increased to the second drive speed Vc, which is the normal processing speed, and is subsequently changed to the first drive speed Vr. The first drive speed Vr may be hereinafter referred to as "low speed. Vr", and the second drive speed Vc may be referred to as "normal speed Vc".

Reference C5 denotes the timing at which the ITB 30 and each photosensitive drum 22 are brought into contact with each other while the ITB 30 and the photosensitive drum 22 are rotating at the normal speed Vc. Reference D5 denotes the timing at which the development rollers 24*a* to 24*d* are brought into contact with the respective photosensitive drums 22 while the photosensitive drums 22 and the ITB 30 are rotating at the normal speed Vc.

Reference E5 denotes the timing at which the ITB 30 is in contact with the photosensitive drums 22*a* to 22*d*, the development rollers 24*a* to 24*d* are in contact with the respective photosensitive drums 22*a* to 22*d*, and the ITB 30, the photosensitive drums 22*a* to 22*d*, and the development rollers 24*a* to 24*d* are rotating at the normal speed Vc. From the timing E5, the speeds of the ITB 30, the photosensitive drums 22, and the respective development units 25 are changed to the lower processing speed Vr.

In the acceleration process between the timing B5 and the timing C5, the drive speed of the photosensitive drum 22 is increased to the normal processing speed Vc, which can suppress vibrations occurring between each photosensitive drum 22 and the corresponding cleaning blade 28 and can reduce generation of an unusual sound.

Note that in the present embodiment, Vc is set at the normal processing speed. The urging force applied to each cleaning blade 28 against the corresponding photosensitive drum 22 is optimized in accordance with the photosensitive drum 22 rotating at the normal processing speed. Accordingly, when the photosensitive drum 22 rotates at the normal processing speed, the vibrations between each photosensitive drum 22 and the corresponding cleaning blade 28 are generated less even if the ITB 30 is not in contact with the photosensitive drum 22.

In the state in which the vibrations between the photosensitive drum 22 and the cleaning blade 28 are generated less, the ITB 30 is brought into contact with the photosensitive drum 22 at the timing C5, and each development roller 24 is brought into contact with the corresponding photosensitive drum 22 at the timing D5. In other words, at the timing E5, a plurality of loads has already been applied to the photosensitive drum 22 (i.e., the ITB 30 and the development roller 24 have already been brought into contact). Thus, even when the drive speed is changed to the low speed Vr, the generation of an unusual sound can be suppressed.

Moreover, by employing the process described above, so-called development fogging can be suppressed. Here, the development fogging means that toner adheres to the photosensitive drum 22 in such a manner as described below.

Toner accommodated in each development unit 25 is conveyed to the corresponding development roller 24 by a toner conveyance device, such as an agitation sheet, and the toner is retained on the development roller 24. By activating the corresponding development roller 24, a corresponding development blade, which serves as a member for regulating the thickness of a toner layer, imparts a predetermined electric charge to the toner and levels the toner bearing amount per unit area on the development roller 24. In the printing process, each development roller 24 is in contact with the corresponding photosensitive drum 22, and in this state, an electrostatic latent image is developed with the charged toner. The charged toner is not adhered to a portion on which the electrostatic latent image is not formed (hereinafter referred to as "unexposed portion").

However, before the development roller 24 starts to be driven, the toner on the development roller 24 is toner remaining after a previous operation, for example, a previous printing job. Such toner may have lost electric charge although the toner bearing amount is made uniform. In this case, when the development roller 24 is brought into contact with the photosensitive drum 22, the toner of which the electric charge is gone may be adhered to the unexposed portion. Moreover, when the development roller 24 is separated from the photosensitive drum 22 after the development roller 24 stops, toner may accumulate in the vicinity of the nip portion between the development roller 24 and the photosensitive drum 22. In this case, the toner may also be adhered to the unexposed portion.

Toner that is adhered to the photosensitive drum 22 when the development roller 24 is brought into contact with or separated from the photosensitive drum 22 is referred to as "fog toner". The fog toner generated during the contact/separation of the development roller 24 may be transferred onto the ITB 30 and adhered to the secondary transfer roller, which may cause a defect, such as a stain on the backside of a recording medium.

Furthermore, when the ITB 30 is shifted from the separation state to the contact state, or vice versa, with respect to the photosensitive drum 22, a mechanical shock may cause the toner on the development roller 24 to adhere to the photosensitive drum 22. In this case, the toner adhering to the photosensitive drum 22 also becomes the fog toner.

In the present embodiment, a common drive source is used as a drive source for driving each photosensitive drum 22 and as a drive source for driving the corresponding development roller 24. As illustrated in FIG. 6, the drive speed of each development roller 24 is controlled to be substantially the same as that of the corresponding photosensitive drum 22. Accordingly, when the development roller 24 is brought into contact with the photosensitive drum 22, the development roller 24 is already rotating. Since the development roller 24 is rotating before being brought into contact with the photosensitive drum 22, the normal electric charge is already imparted to the toner on the development roller 24. This can suppress fog toner adhering to the photosensitive drum 22 when or after each development roller 24 is brought into contact with the corresponding photosensitive drum 22. Note that the development rollers 24 and photosensitive drum 22 may be driven by separate drive sources.

The way to suppress vibrations of each cleaning blade 28 and the corresponding photosensitive drum 22 when the drive speed of the photosensitive drum 22 is increased from the stop state to the low speed Vr has been described. Similarly, a way to suppress vibrations while each photosensitive drum 22 rotating at the low speed Vr is decelerated to stop will be described below.

Figure 7:
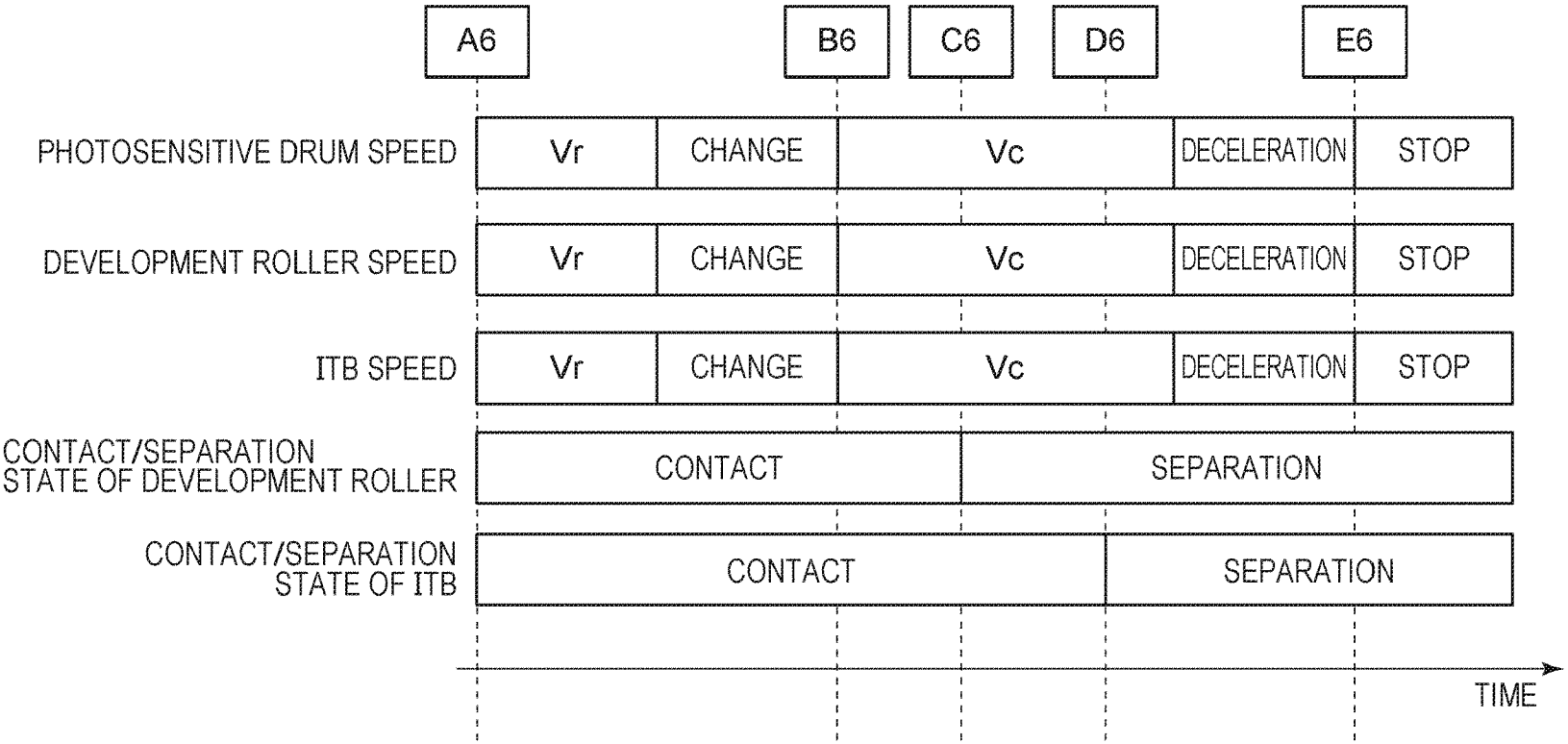
FIG. 7 is a view illustrating discrete states in relation to time in a deceleration process according to the first embodiment.

FIG. 7 illustrates a relationship of the drive speed of the photosensitive drums 22*a* to 22*d*, the drive speed of the ITB 30, the contact/separation state of the ITB 30 and the photosensitive drums 22*a* to 22*d*, the contact/separation state of the development rollers 24*a* to 24*d* and the photosensitive drums 22*a* to 22*d*, and time.

Reference A6 denotes an initial state, and references B6, C6, D6, and E6 denote timing of discrete state changes.

Reference A6 denotes the timing at which the ITB 30 is in contact with the photosensitive drums 22*a* to 22*d*, the development rollers 24*a* to 24*d* are in contact with the respective photosensitive drums 22*a* to 22*d*, and the ITB 30, the photosensitive drums 22*a* to 22*d*, and the development rollers 24*a* to 24*d* are rotating at the low speed Vr.

As indicated by the timing B6, the peripheral speed of each photosensitive drum 22 and the ITB 30 is changed from the state at the timing A6 to the normal speed Vc. The ITB 30 and each development roller 25 are separated from the corresponding photosensitive drum 22 after the timing B6. In a state at the timing D6, the ITB 30 and the development roller 25 are separated from the photosensitive drum 22. However, since the photosensitive drum 22 is rotating at the normal speed Vc, vibrations do not occur easily between the photosensitive drum 22 and the corresponding cleaning blade 28. The drive speed of the photosensitive drum 22 is decreased from the state at the timing D6 in which vibrations do not occur easily.

With this deceleration process, vibrations generated between each photosensitive drum 22 and the corresponding cleaning blade 28 can be suppressed, and generation of an unusual sound can be reduced.

Note that a configuration in which the acceleration process and the deceleration process are both performed has been described in the present embodiment. However, either the acceleration process or the deceleration process may be performed in certain circumstances.

A configuration in which the ITB 30 serves as the transfer belt has been described above. However, a conveyor belt that conveys a recording medium P may be used as the transfer belt.

The slowest speed among the drive speeds that can be set by the drive control unit 108 is set as the first speed. However, the first speed may be another drive speed. For example, the first speed may be set at an intermediate speed that is slower than the normal speed Vc and faster than the low speed Vr. In this case, it is sufficient to perform the above-described processes only when the drive speed is accelerated to, or decelerated from, the slowest speed among the drive speeds that can be set by the drive control unit 108.

According to embodiments of the invention, when the photosensitive drums start to be driven, wear of the photosensitive drums and vibrations occurring between the photosensitive drums and the respective cleaning blades can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-163745 filed Aug. 28, 2017, which is hereby incorporated by reference herein in its entirety.

What is claimed is:

1. An image forming apparatus, comprising:

a photosensitive drum that bears a toner image;

a cleaning unit that is in contact with the photosensitive drum and cleans toner from the photosensitive drum;

a transfer belt that transfers the toner image from the photosensitive drum to a recording medium; and a control unit that controls drive speed of the photosensitive drum, wherein the control unit drives the photosensitive drum at a first drive speed that is the slowest among drive speeds that can be set by the control unit in a case that the photosensitive drum and the transfer belt are separated from each other and the photosensitive drum stops, and wherein the control unit subsequently changes the drive speed of the photosensitive drum from a second drive speed to the first drive speed after the transfer belt is brought into contact with the photosensitive drum that is driven at the second drive speed, the second drive speed being faster than the first drive speed.

2. The image forming apparatus according to claim 1, further comprising a first drive source that drives the photosensitive drum and a second drive source that drives the transfer belt, wherein the first drive source and the second drive source are different drive sources.

3. The image forming apparatus according to claim 1, further comprising a first drive source that drives the photosensitive drum and a second drive source that drives the transfer belt, wherein the first drive source and the second drive source are a common drive source.

4. The image forming apparatus according to claim 1, further comprising a development roller that can be in contact with, and separated from, the photosensitive drum and by which the toner image is developed onto the photosensitive drum, wherein when the control unit drives the photosensitive drum to the first drive speed from a state in which the transfer belt and the development roller are separated from the photosensitive drum and the photosensitive drum stops, the control unit first drives the photosensitive drum at a second speed that is faster than the first drive speed, and the control unit subsequently changes the drive speed of the photosensitive drum from the second drive speed to the first drive speed after the development roller is brought into contact with the photosensitive drum that is driven at the second drive speed.

5. The image forming apparatus according to claim 4, wherein a timing at which the development roller is brought into contact with the photosensitive drum is after the transfer belt is brought into contact with the photosensitive drum.

6. The image forming apparatus according to claim 5, wherein when the control unit drives the photosensitive drum to the first drive speed from a state in which the transfer belt and the development roller are separated from the photosensitive drum and the photosensitive drum stops, the control unit controls drive speeds of the photosensitive drum, the transfer belt, and the development roller to be the same drive speed.

7. The image forming apparatus according to claim 1, wherein when a state of the photosensitive drum and transfer belt is changed from a state in which the photosensitive drum and the transfer belt are in contact with each other and the photosensitive drum is driven at the first drive speed to a state in which the photosensitive drum and the transfer belt are separated from each other and the photosensitive drum stops, the control unit first drives the photosensitive drum at the second speed, and the control unit subsequently stops driving the photosensitive drum after the transfer belt is separated from the photosensitive drum that is driven at the second drive speed.

8. The image forming apparatus according to claim 1, wherein the cleaning unit is a cleaning blade that has elasticity.

9. The image forming apparatus according to claim 1, wherein the transfer belt is an intermediate transfer belt onto which the toner image is primary-transferred from the photosensitive drum.

10. The image forming apparatus according to claim 1, wherein the photosensitive drum is a plurality of the photosensitive drums that bear respective toner images of colors that are different from each other.

11. An image forming apparatus, comprising:

a photosensitive drum that bears a toner image;

a cleaning unit that is in contact with the photosensitive drum and cleans toner from the photosensitive drum;

a transfer belt that can be in contact with, and separated from, the photosensitive drum and that transfers the toner image from the photosensitive drum to a recording medium; and a control unit that controls drive speed of the photosensitive drum, wherein when a state of the photosensitive drum and transfer belt is changed from a state in which the photosensitive drum and the transfer belt are in contact with each other and the photosensitive drum is driven at a first drive speed that is the slowest among drive speeds that can be set by the control unit, to a state in which the photosensitive drum and the transfer belt are separated from each other and the photosensitive drum stops, the control unit first drives the photosensitive drum at a second speed that is faster than the first drive speed, and the control unit subsequently stops driving the photosensitive drum after the transfer belt is separated from the photosensitive drum that is driven at the second drive speed.

12. The image forming apparatus according to claim 11, further comprising a first drive source that drives the photosensitive drum and a second drive source that drives the transfer belt, wherein the first drive source and the second drive source are different drive sources.

13. The image forming apparatus according to claim 11, further comprising a first drive source that drives the photosensitive drum and a second drive source that drives the transfer belt, wherein the first drive source and the second drive source are a common drive source.

* * * * *